United States Patent [19]

Yamagishi

[11] Patent Number: 4,585,333

[45] Date of Patent: Apr. 29, 1986

[54] SEPARATED COMMUNICATION BETWEEN ELECTROPHOTOGRAPHIC COPYING MACHINE AND ITS SUBSYSTEM

[75] Inventor: Toshio Yamagishi, Nara, Japan

[73] Assignee: Sharp, Kabushiki Kaisha, Osaka, Japan

[21] Appl. No.: 630,292

[22] Filed: Jul. 12, 1984

[30] Foreign Application Priority Data

Jul. 29, 1983 [JP] Japan ..... 58-140758

[51] Int. Cl.[4] ..... G03G 15/00

[52] U.S. Cl. ..... 355/14 R; 355/3 SH; 355/14 SH

[58] Field of Search ..... 355/3 SH, 14 SH, 3 R, 355/14 R; 271/288, 289, 290

[56] References Cited

U.S. PATENT DOCUMENTS

| | | | |
|---|---|---|---|
| 4,370,052 | 1/1983 | Murakami et al. | 355/3 SH X |
| 4,405,225 | 9/1983 | Perrault | 355/3 SH X |
| 4,449,812 | 5/1984 | Furuichi et al. | 355/3 SH X |

*Primary Examiner*—A. C. Prescott

*Attorney, Agent, or Firm*—Birch, Stewart, Kolasch & Birch

[57] ABSTRACT

An electrophotographic copying machine comprises a body for accommodating a number of elements to execute a copying operation, a subsystem such as a sorter for sorting a plurality of copied papers in the copied order on each of shelves, and an optical communication system between the body of the copying machine and the sorter. For the optical communication system, the sorter includes some light emitting diodes while the copying machine includes some light receiving elements. In place of optical communication, magnetic communication may be provided.

11 Claims, 2 Drawing Figures

SEPARATED COMMUNICATION BETWEEN ELECTROPHOTOGRAPHIC COPYING MACHINE AND ITS SUBSYSTEM

BACKGROUND OF THE INVENTION

The present invention relates to an electrophotographic copying machine and, more particularly, to a separated communication between an electrophotographic copying machine and its subsystem.

An electrophotographiccopying machine produces an electrostatic latent image onto a photoreceptor corresponding to a pattern image on a document such as a manuscript or book to be copied. Toner particles are electrostatically adhered to the latent image, so that the latent image becomes visible as a toner image. The toner image on the photoreceptor is transferred onto a copy paper via a transference charger.

There are some copying machines of the type comprising a sorter for sorting a number of copied papers in the orer of copying so as to align the copied papers in the order of pages. Conventionally, such a sorter is electrically coupled to the copied-paper outlet of the main body of the copying machine, so that electrical signals are supplied representative of whether the sorter is operated to subsequently overlay the copied papers on a tray. Otherwise the sorter is operated to align the copied papers in the copied order. In such a case, a cable means is usually provided for supplying the electrical signals. However, since the sorter is detachably combined with the main body of the copying machine, the provision of the cable means is troublesome when the sorter should be detached. It is possible for the cable means to twist or fold so as to fail to provide the electrical signal communication.

SUMMARY OF THE INVENTION

Accordingly, it is an object of the present invention to provide an improved electrical communication system between an electrophotographic copying machine and its subsystem.

It is another object of the present invention to provide an improved separated communication between an electrophotographic copying machine and a sorter.

It is a further object of the present invention to provide an improved optical or magnetic communication between an electrophotographic copying machine and a sorter.

Briefly described, in accordance with the present invention, an electrophotographic copying machine comprises a main body for accommodating a number of elements to execute a copying operation, a subsystem such as a sorter for sorting a plurality of copied papers in the copied order on each of a plurality of shelves in the sorter, and an optical communication system between the body of the copying machine and the sorter. For the optical communication system, the sorter includes some light emitting diodes while the copying machine includes some light receiving elements. In place of the optical communication system, magnetic communication may be provided.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
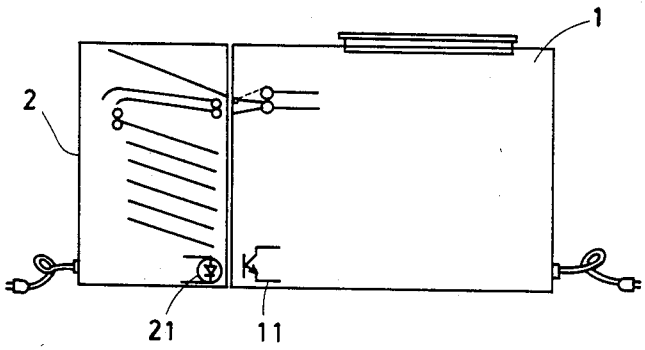
FIG. 1 is a schematic view of a side of the combination of a sorter and a body of an electrophotographic copying machine according to the present invention.

FIG. 1 is a schematic side view of the combination of a sorter and a body of an electrophotographic copying machine according to the present invention.

A sorter 2 is detachably and mechanically coupled to a body of an electrophotographic copying machine 1 comprising a number of elements to execute a copying operation although any further description of these elements is omitted. The sorter 2 includes a number of shelves and a transport means for transporting every copied paper into each of the shelves. Then, each group of copied papers are deposited on each of the shelves in the sorter 2 when it is energized. Since the order of depositing some copied papers on every shelf is in the copied order, some copied papers are deposited on every shelf in the order of pages when the documents to be copied are copied in the page order. The correct electrical signal communication between the copying machine 1 and the sorter 2 is provided by separated source and receiving elements which effect communication. The communication is enabled by a light emitting means 21 such as a light emitting diode (LED) in the sorter side, and a light receiving means 11 such as a phototransistor in the copying machine side. The light emitting means 21 and the light receiving means 11 are positioned so that the light from the light emitting means 21 is incident upon the light receiving means 11 when the sorter 2 is properly combined with the copying machine 1. Each power plug is provided in each of the body of the copying machine 1 and the sorter 2.

When the sorter 2 is properly combined with the copying machine 1 and is effectively operated, the light emitting means 21 provides a signal representative of the properly operative condition of the sorter 2. The light is incident upon the light receiving means 11 of the copying machine 1, so that the copying machine 1 can detect that the sorter 2 is operatively coupled, whereby the copying machine 1 starts to forward one or more copied papers into the sorter 2.

When a paper jam occurs in the sorter 2, the light emitting means 21 is switched off, so that the light from the light emitting means 21 cannot be incident upon the light receiving means 11. The copying machine 1 can stop forwarding the one or more copied papers into the sorter 2. The copying machine 1 may stop the copying operation, also. It may be possible that, upon the occurrence of the jam in the sorter 2, the copying machine 1 stops forwarding the one or more copied papers into the sorter 2 and, by changing the direction of paper transport, starts forwarding them into a paper exhaust tray to overlay the copied papers in layers.

Since the light cannot emit from the light emitting means 21 if the sorter 2 and the copying machine 1 are improperly aligned, the communication means can serve as a subsystem-attachment detection means. According to the present invention, a cable means for electrically coupling the sorter 2 and the copying machine 1 can be eliminated.

Figure 2:
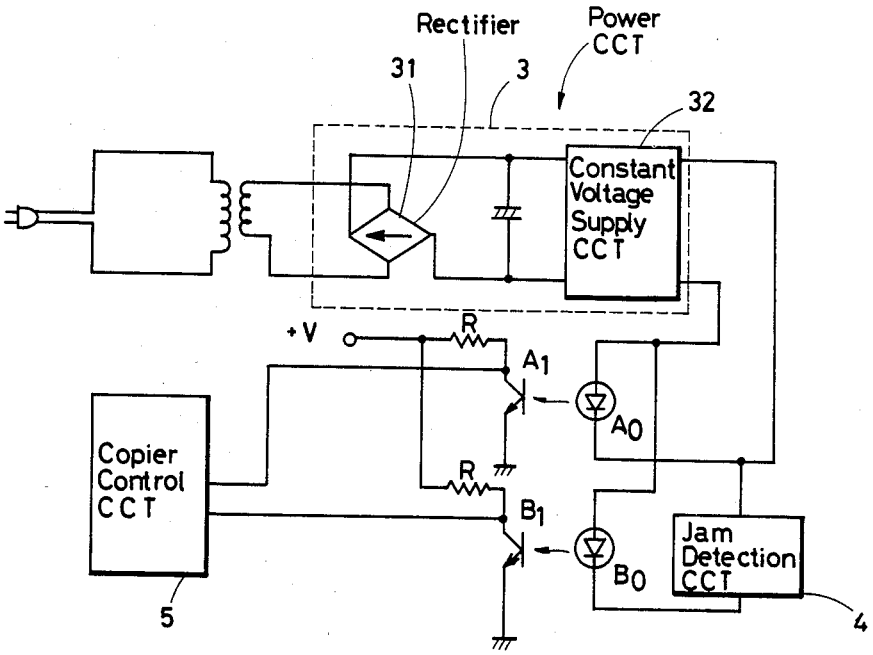
FIG. 2 is a block diagram of a circuit formed in the combination of the sorter and the copying machine according to the present invention.

FIG. 2 is a block diagram of a circuit formed in the combination of the sorter 2 and the copying machine 1 according to the present invention.

The circuit comprises a power source, a power circuit 3 including a rectifier 31 and a voltage supply circuit 32, a jam detection circuit 4, a pair of light emitting diodes (LEDs) A0 and B0 which are all included within the sorter 2, and a pair of phototransistors A1 and B1, and a copier control circuit 5 which are all included within the copying machine 1.

The pair of LEDs A0 and B0 are in parallel connected to the power circuit 3. The power circuit 3 comprises a rectifier 31 for rectifying an AC power to a DC power and a constant voltage supply circuit 32. The LED B0 is driven via the jam detection circuit 4 by the power circuit 3, so that, while the jam detection circuit 4 detects any paper jam, the LED B0 is switched off.

Each of the phototransistors A1 and B1 face each of the LEDs A0 and B0 in proper arrangement. A power source +V is applied to the collectors of the phototransistors A1 and B1 via each resistance R. The emitters of the phototransistors are then grounded. The collectors of the phototransistors A1 and B1 as their output terminals are connected to the copier control circuit 5. The copier control circuit 5 is responsive to the light input into each of the phototransistors A1 and B1 for enabling the forward movement of the copied paper into the sorter 2. The control circuit is responsive to the absence of the light incident into the phototransistor B1 for stopping forward movement of the one or more copied papers into the sorter 2 because it detects any jam occurring in the sorter 2. The control circuit is further responsive to the absence of the light incident upon the phototransistor A1 for executing a normal copying operation, in which the one or more copied papers are exhaused onto the tray rather than into the sorter 2, because it detects that the sorter 2 is not combined with the body of the copying machine 1.

When the sorter 2 is mechanically and electrically connected to the body of the copying machine 1, the light beams from the LEDs A0 and B0 are incident upon the phototransistors A1 and B1 in the copying machine side, so that the signals received are applied into the copier control circuit 5. Then, the copier control circuit 5 is responsive to the copying instructions from the copying machine 1 for enabling the one or more copied papers to be forwarded into the sorter 2. If no page sorting instructions are input, the copier control circuit 5 enables the one or more copied papers to be merely deposit on the exhaust tray in layers.

When any jam occurs in the sorter 2, the jam detection circuit 4 is operated to switch off the LED B0. The absence of the light incidence from the LED B0 permits the copying operation to be enabled, so that the operator is informed of the jam occurring in the sorter 2.

When neither of the phototransistors A1 or B1 can receive any incident light, it is detected by the copier control circuit 5 that the sorter 2 is not mechanically and electrically connected to the body of the copying machine 1. Then, the copier control circuit 5 selects and executes the normal copying operation, in which the one or more copied papers are merely deposited onto the paper exhaust tray in layers rather than forwarding them into the sorter 2. If the page sorting instruction is externally inputted, it may be possible that the operator is alarmed that the sorter is not mechanically and electrically coupled to the body of the copying machine 1 with the nonconductness of the copying operation or otherwise that the copying operation is executed with the one or more copied papers deposited onto the exhaust tray in layers.

The optical coupling means of the LED A0 and the phototransistor A1 are operated to detect whether the sorter 2 is properly coupled to the body of the copying machine 1. The other optical coupling means of the LED B0 and the phototransistor B1 are operated to detect whether any paper jam occurs or not.

In the above preferred embodiment of the present invention, the LEDs A0 and B0 are installed in the sorter 2 while the light receiving means are installed in the body of the copying machine 1. It may be possible that, to transmit the signals from the body of the copying machine 1 to the sorter 2, the LEDs are installed in the body of the copying machine 1 and the light receiving means are installed in the sorter 2.

According to the gist of the present invention, the optical coupling means may be replaced by magnetic coupling means. In such a case, the sorter 2 includes an electromagnet while the body of the copying machine 1 has a reed switch. Attachment of the sorter can be detected by the condition of the lead switch switched on and off. Upon the occurrence of the jam, the power to the electromagnet is shut out, so that the condition of the reed switch can be reversed.

Further, it may be possible that the sorter 2 to be detachably connected to the body of the copying machine 1 can be replaced by other elements such as an automatic document feeder for automatically feeding the copy document onto the document table, a coin change supplier for making change for copying charges connected to a "pay-copying" machine, or the like.

In the above preferred embodiment of the present invention, the jam detection means for detecting the jam occurrence and the copier control circuit responsive to the detection of the jam detection means are known to the ordinary skilled in the art. Any further description is omitted.

While only certain embodiments of the present invention have been described, it will be apparent to those skilled in the art that various changes and modifications may be made therein without departing from the spirit and scope of the present invention as claimed.

What is claimed is:

1. A system comprising:

an electrophotographic copying machine;

a subsystem provided for use with said copying machine for performing functions related to copying;

communication means for communicating all subsystem operation state information from said subsystem to said copying machine, while providing electrical isolation between the copying machine and the subsystem; and control means, responsive to operation state information communicated by said communication means, for enabling copy operations in said copying machine.

2. A system according to claim 1, wherein said subsystem operation state information includes sorter state information.

3. A system according to claim 2, wherein said sorter state information includes means for sensing a paper jam and for providing said information to said communication means.

4. A system according to claim 1, wherein said communication means comprises communication source means mounted on said subsystem for developing a non-electrical signal representative of all operation subsystem state information, and communication receiving means for receiving said non-electrical signal.

5. A system according to claim 4, wherein said non-electrical signal is an optical signal.

6. A system according to claim 4, wherein said non-electrical signal is an electromagnetic signal.

7. The system according to claim 4, wherein said subsystem is a sorter for sorting a plurality of copied papers.

8. The system according to claim 4, wherein said communication source means comprises a light emitting element and said communication receiving means comprises a light receiving element.

9. The system according to claim 6, wherein said electromagnetic signal includes an electromagnet in said subsystem and a reed switch in said copying machine.

10. The system according to claim 1, wherein said subsystem is detachably connected to said copying machine.

11. The system according to claim 1, wherein said subsystem is an automatic document feeder or a coin change supplier.

* * * * *